US009027575B2

(12) United States Patent
Cantrell et al.

(10) Patent No.: US 9,027,575 B2
(45) Date of Patent: May 12, 2015

(54) FLUID SCREEN FOR POT AND PAN WASHING MACHINE

(75) Inventors: John W. Cantrell, Leawood, KS (US); Mark Churchill, Grain Valley, MO (US)

(73) Assignee: Unified Brands, Inc., Jackson, MI (US)

( * ) Notice: Subject to any disclaimer, the term of this patent is extended or adjusted under 35 U.S.C. 154(b) by 157 days.

(21) Appl. No.: 13/332,360

(22) Filed: Dec. 20, 2011

(65) Prior Publication Data

US 2012/0298140 A1 Nov. 29, 2012

Related U.S. Application Data

(60) Provisional application No. 61/425,118, filed on Dec. 20, 2010.

(51) Int. Cl.

| | |
|---|---|
| ***B08B 3/04*** | (2006.01) |
| ***B08B 13/00*** | (2006.01) |
| ***A47L 15/42*** | (2006.01) |
| *A47L 15/00* | (2006.01) |

(52) U.S. Cl.

CPC ..... *A47L 15/4246* (2013.01); *A47L 15/0092* (2013.01)

(58) Field of Classification Search

CPC ..... A47L 15/4204; A47L 15/0092; A47L 15/4246; A47L 11/4027; D06F 1/02; B08B 3/02; B08B 3/102

USPC ..... 134/182, 110, 183

See application file for complete search history.

(56) References Cited

U.S. PATENT DOCUMENTS

| | | | | |
|---|---|---|---|---|
| 1,923,722 | A * | 8/1933 | Goodwin | 134/68 |
| 2,103,796 | A | 12/1937 | Seip | |
| 3,236,382 | A * | 2/1966 | Bosman | 209/457 |
| 5,725,002 | A | 3/1998 | Payzant | |
| 5,809,807 | A * | 9/1998 | Seo | 68/23.6 |
| 6,079,427 | A * | 6/2000 | Perry, Jr. | 134/104.4 |
| 2009/0120466 | A1 * | 5/2009 | Eshima | 134/36 |
| 2009/0178292 | A1 | 7/2009 | Stengel | |

FOREIGN PATENT DOCUMENTS

| | | |
|---|---|---|
| GB | 779003 | 7/1957 |
| WO | WO 2010/124149 | 10/2008 |

OTHER PUBLICATIONS

International Search Report in PCT/IB2011/003333.

* cited by examiner

*Primary Examiner* — Michael Kornakov
*Assistant Examiner* — Natasha Campbell
(74) *Attorney, Agent, or Firm* — Kutak Rock LLP; Bryan P. Stanley

(57) ABSTRACT

A fluid screen for a washing machine, and a washing machine including a fluid screen, is provided. The fluid screen includes a generally planar member including a first end and a second end extending from the first end. The first end is mounted within the wash tank of the washing machine at a location generally in proximity to an operating fluid level within the wash tank. During operation of the washing machine, fluid circulates within the wash tank to create a rolling wash action and the second end of the fluid screen extends from the first end generally in the direction of fluid flow across the surface of the wash tank.

18 Claims, 11 Drawing Sheets

Fig. 6b
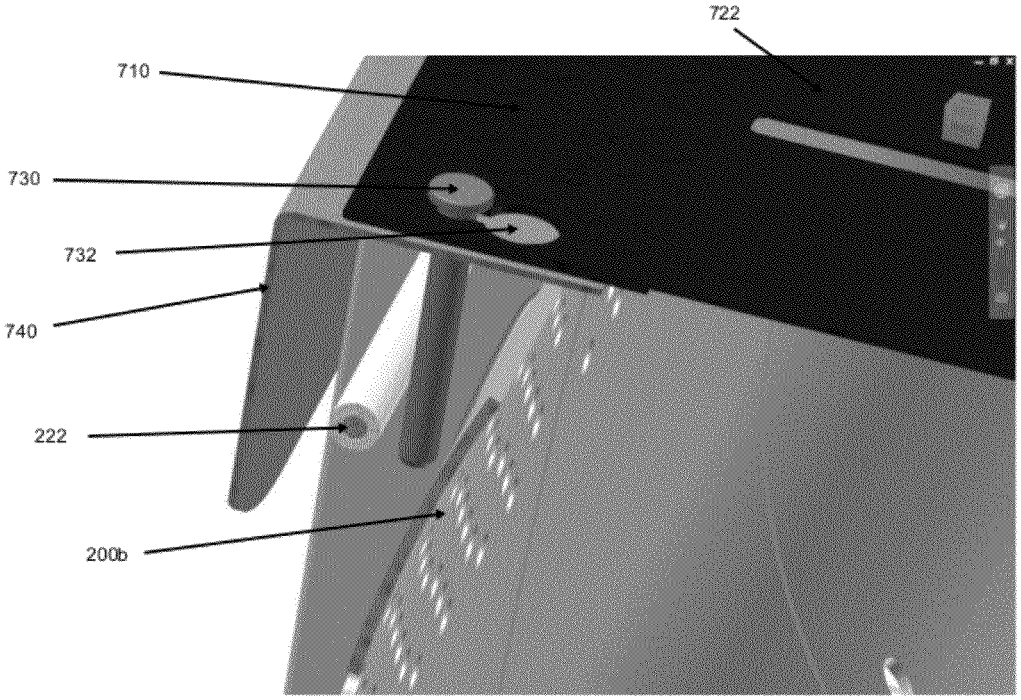
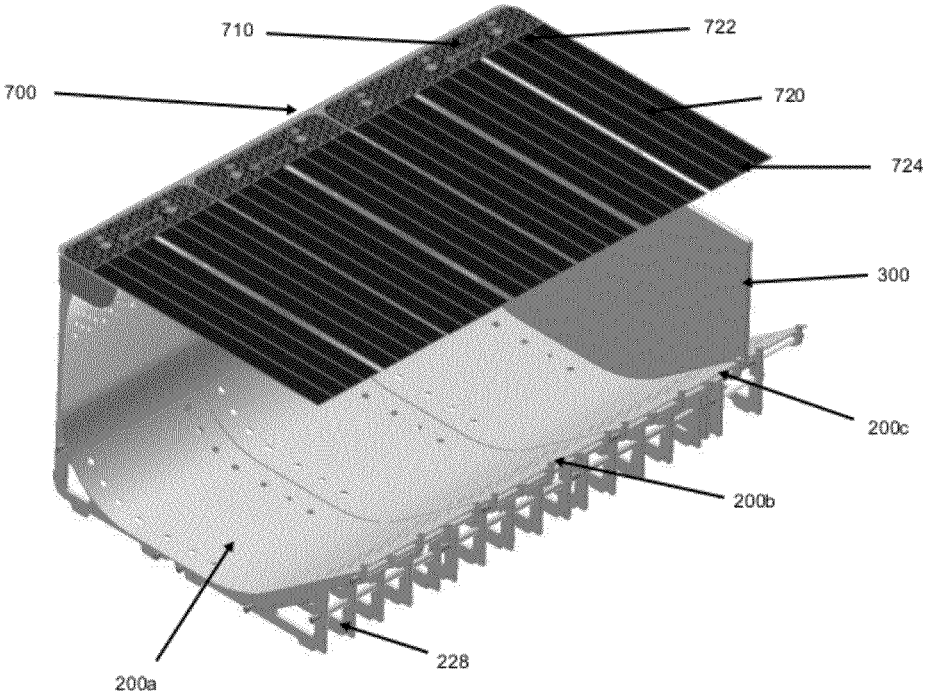
Fig. 6a

MATERIAL THICKNESS 1/16 in
ONE PIECE FOLDED TO CREATE TWO LAYERS 1/8 in
3.00
3.00 BOTH LAYERS TO BE BONDED IN THIS AREA
DETAIL A 0.99
0.63
Ø0.75
0.32
Ø0.44
DETAIL B
TYP 3 PLACES 0.13
1.00
0.13
R0.13 TYP
DETAIL C
TYP 2 PLACES 11.75
5.38
5.38
(1.34)
24.00
2.88
6.00
R1.00
MAKE CUTS TO DIVIDE EACH SECTION INTO FOUR EQUAL (± 0.06) STRIPS 720
710
722
760
750
724
732
A
B
C

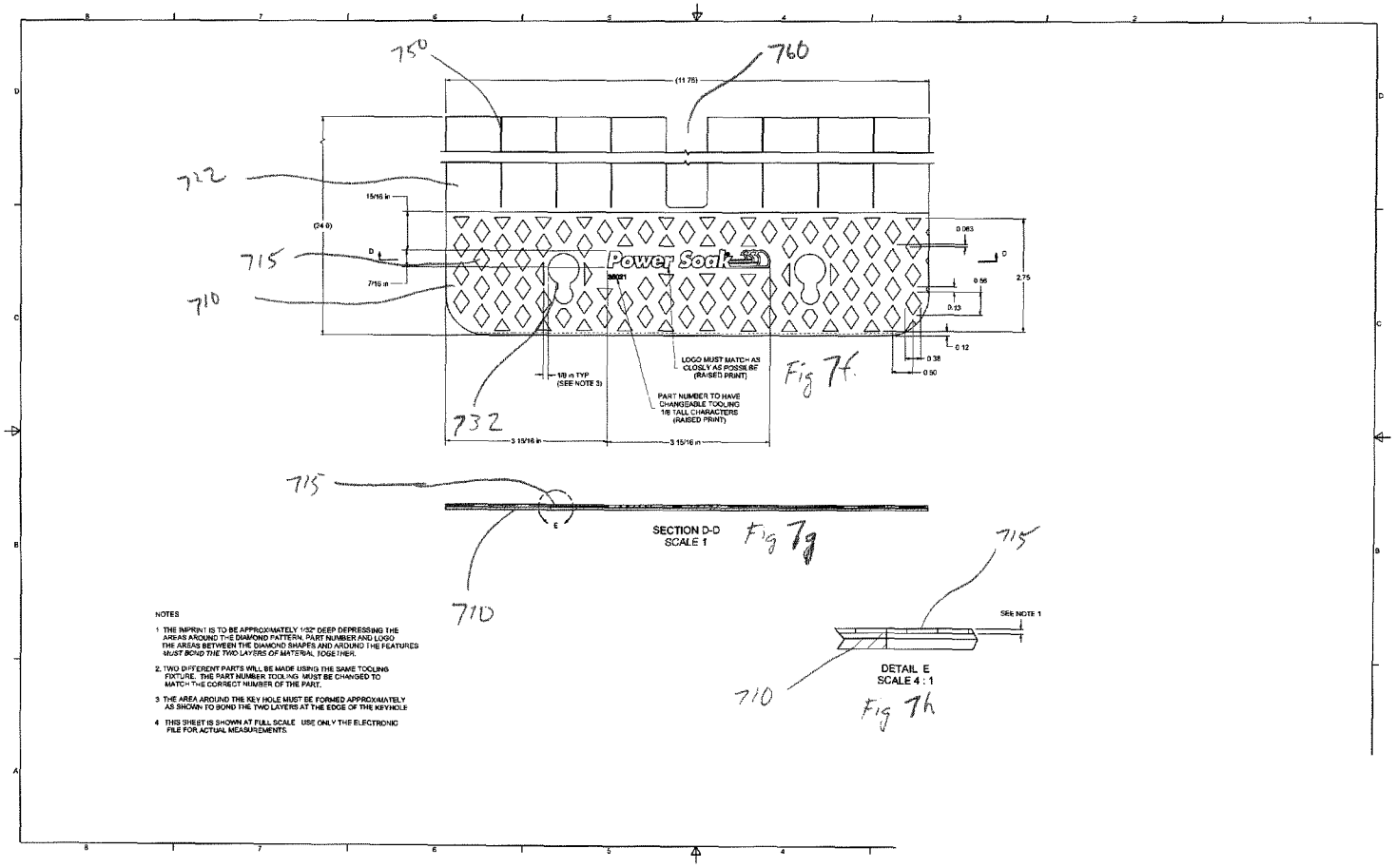
760
750
722
715
710
732
Power Seal
LOGO MUST MATCH AS CLOSELY AS POSSIBLE (RAISED PRINT)
PART NUMBER TO HAVE CHANGEABLE TOOLING 1/8" TALL CHARACTERS (RAISED PRINT)
.100 in TYP (SEE NOTE 3)
Fig 7f
SECTION D-D
SCALE 1
Fig 7g
DETAIL E
SCALE 4 : 1
SEE NOTE 1
Fig 7h
NOTES
1 THE IMPRINT IS TO BE APPROXIMATELY 1/32" DEEP DEPRESSING THE AREAS AROUND THE DIAMOND PATTERN. PART NUMBER AND LOGO MUST BE RAISED PRINT. THE DIAMOND PATTERN AND THE FEATURES MUST ROUGH THE TWO LAYERS OF MATERIAL. ROSE TREE.
2 TWO DIFFERENT PARTS WILL BE MADE USING THE SAME TOOLING FIXTURE. THE PART NUMBER TOOLING MUST BE CHANGED TO MATCH THE CORRECT NUMBER OF THE PART.
3 MATCH THE CORRECT NUMBER OF THE PART.
4 THE PARTS ARE TO HAVE THE EDGES ROUNDED APPROXIMATELY AS SHOWN TO PROTECT THE VINYL LATER AT THE EDGE OF THE ANVIL.
5 THIS SHEET IS SHOWN AT FULL SCALE. USE ONLY THE ELECTRONIC FILE FOR ACTUAL MEASUREMENTS.

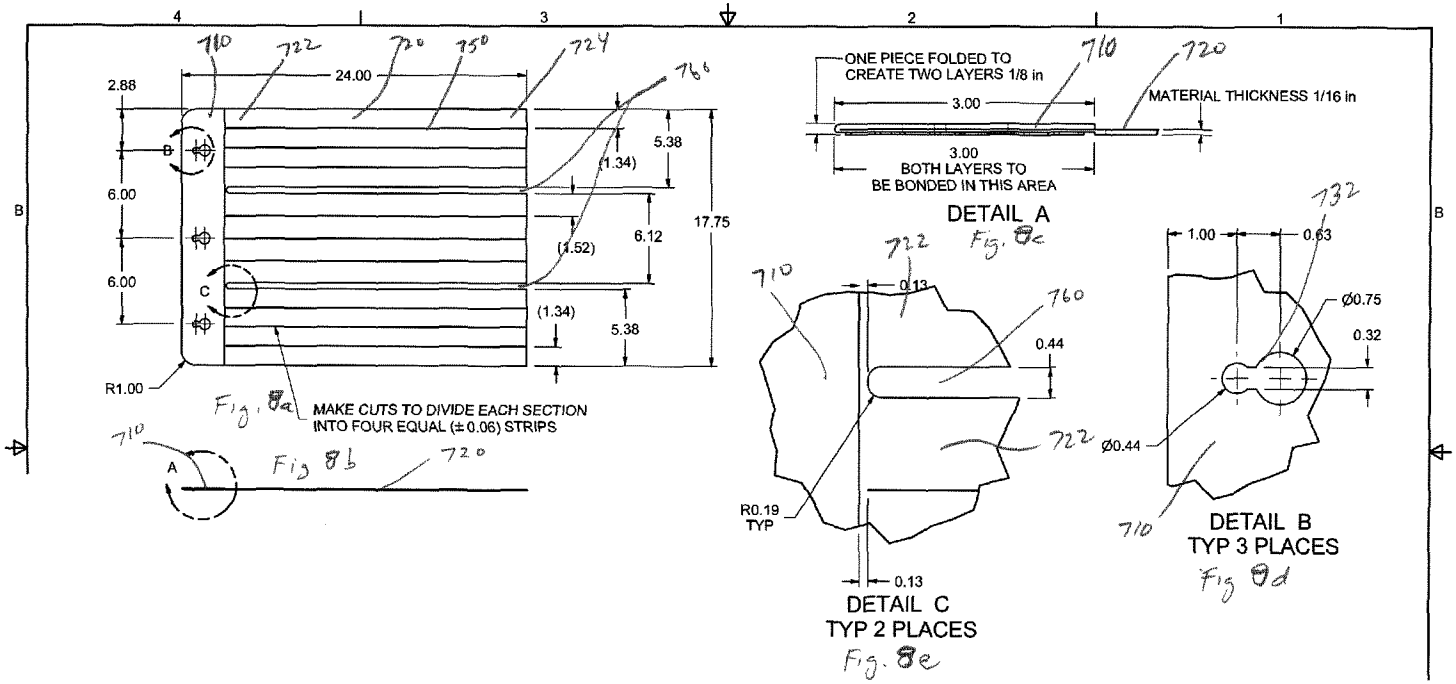
MATERIAL THICKNESS 1/16 in
ONE PIECE FOLDED TO CREATE TWO LAYERS 1/8 in
3.00
3.00 BOTH LAYERS TO BE BONDED IN THIS AREA
DETAIL A
DETAIL B TYP 3 PLACES
DETAIL C TYP 2 PLACES
R0.19 TYP
MAKE CUTS TO DIVIDE EACH SECTION INTO FOUR EQUAL (±0.06) STRIPS
17.75
5.38
6.12
(1.34)
(1.52)
24.00
2.88
6.00
R1.00
Ø0.75
Ø0.44
0.32
0.63
1.00
0.44
0.13

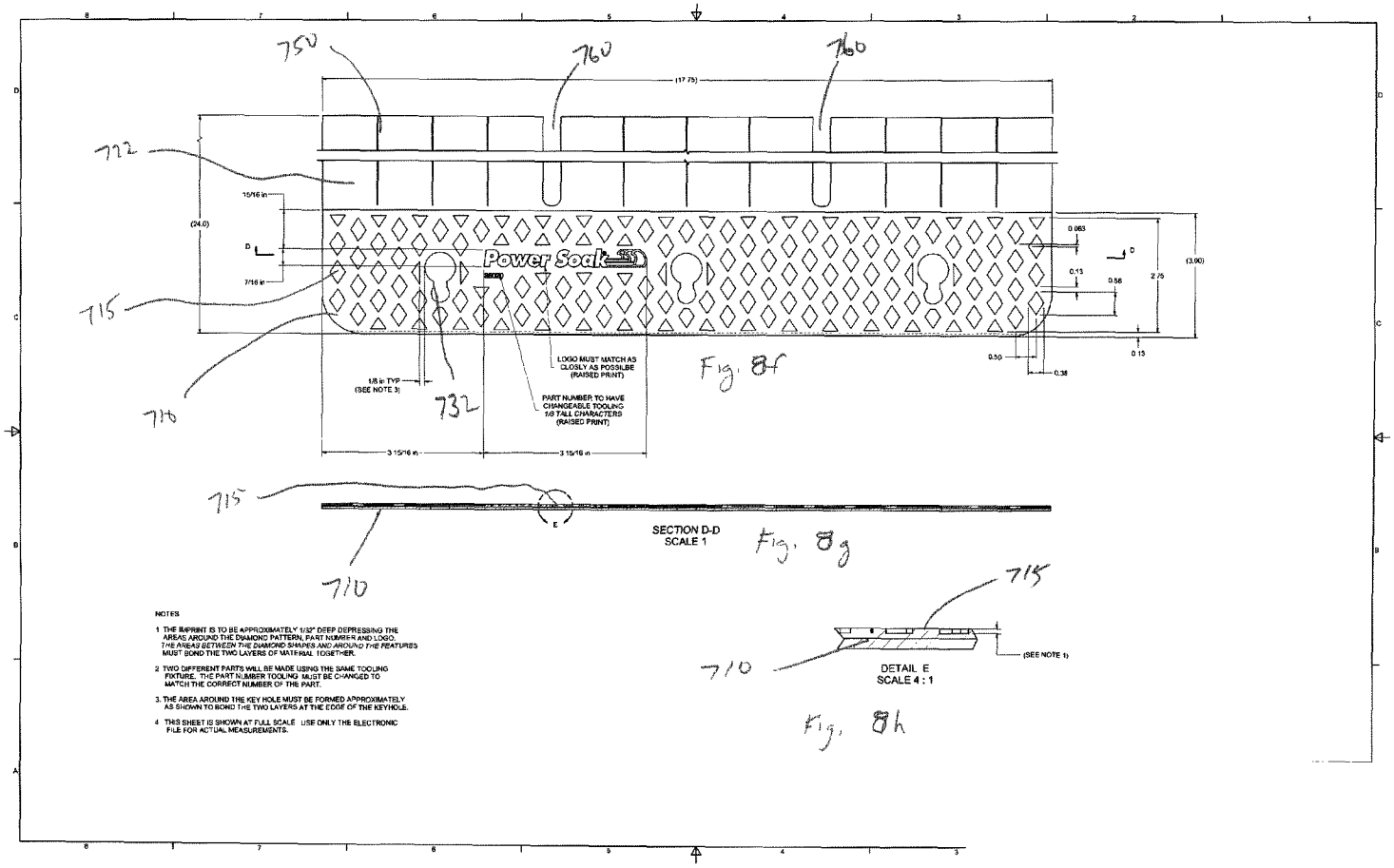
Power Seal
LOGO MUST MATCH AS CLOSELY AS POSSIBLE (RAISED PRINT)
PART NUMBER TO HAVE CHAMFERED CORNERS 1/8 TALL CHARACTERS (RAISED PRINT)
(SEE NOTE 2)
SECTION D-D SCALE 1
DETAIL E SCALE 4 : 1
(SEE NOTE 1)
NOTES
1 THE IMPRINT IS TO BE APPROXIMATELY 1/32" DEEP DEPRESSING THE AREAS AROUND THE DIAMOND PATTERN, PART NUMBER AND LOGO. THE AREAS LISTED ABOVE SHOULD HAVE NO DIAMOND PATTERN. THE PARTS MUST BOND THE TWO LAYERS OF MATERIAL TOGETHER.
2 TWO DIFFERENT PARTS WILL BE MADE USING THE SAME TOOLING FIXTURE. THE PART NUMBER TOOLING MUST BE CHANGED TO INDICATE THE CORRECT PART NUMBER. THE PART NUMBER MUST BE CHANGED.
3 THE AREA AROUND THE KEY HOLE MUST BE FORMED APPROXIMATELY AS SHOWN TO BOND THE TWO LAYERS AT THE EDGE OF THE KEYHOLE.
4 THIS SHEET IS SHOWN AT FULL SCALE USE ONLY THE ELECTRONIC FILE FOR ACTUAL MEASUREMENTS.
Fig. 8f
Fig. 8g
Fig. 8h

FLUID SCREEN FOR POT AND PAN WASHING MACHINE

CROSS-REFERENCE TO RELATED APPLICATIONS

This application claims priority pursuant to 35 U.S.C. 119 (e) to U.S. Provisional Patent Application Ser. No. 61/425,118, filed Dec. 20, 2010, the entire disclosure of which is incorporated herein by reference.

FIELD OF THE INVENTION

The present invention relates generally to washing machines. More specifically, the present invention is concerned with a fluid screen for a pot and pan, or other similar washing machines, and washing machines including a fluid screen.

BACKGROUND OF THE INVENTION

Pot and pan washing machines, of the type used in restaurants, institutions and other eating facilities often involve a large wash tank or basin in which water or other cleaning fluid is circulated to provide a continuous motion rolling wash action for the pots and pans and other "wares" (i.e. pots, pans, utensils, flatware/silverware, etc.). One such continuous motion style pot and pan washing machine is described in U.S. Pat. No. 4,773,436 issued to Cantrell et al., the entire disclosure of which is incorporated herein by reference. The machine of Cantrell includes a wash tank with multiple jets evenly spaced apart at an elevated position along the rear wall of the wash tank. The tank is filled with fluid (i.e. water, detergent, etc.) to a level above the position of the jets. Pots and pans are placed in the wash tank, and a wash pump is activated to draw fluid from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank. Typically, the rolling wash action is continuous through the washing cycle of the machine, and wares are loaded and unloaded during the washing cycle as they are deemed clean by an operator of the machine. In this manner, multiple loads of wares are cleaned during a single washing cycle.

The basic components of the wash tank of an exemplary pot and pan washing machine of the prior art are shown in FIG. 1. Wash tank 10 includes end walls 12 and 14, rear side wall 16, front side wall 18 and bottom wall 19. A pump can be attached to either end wall; in the embodiment shown in FIG. 1, pump 50 is attached to right end wall 14. An impeller located within pump 50 is driven by electric motor 56. The impeller draws fluid into pump inlet 52 through an intake port (not shown) located in end wall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 ("flow directional openings") which are protruding through and extending from rear wall 16. The intake port associated with pump inlet 52 is covered by perforated (holes, voids, mesh, etc.) intake manifold 30. Intake manifold 30 includes handle 36 and is removably supported within wash tank 10 for easy cleaning Intake manifold 30 fits tightly between outer runner 32 and inner runner 34, each of which extends vertically from bottom wall 19. Heating element 40 is positioned between intake manifold 30 and end wall 14 for its protection and to maximize the use of space.

Although the prior art pot and pan washing machine disclosed in U.S. Pat. No. 4,773,436 provides an exceptional wash action, many of the components discussed above hinder the overall efficiency and performance of the machine. The inventions disclosed in U.S. Pat. Nos. 6,739,348, 7,162,788, 6,976,496, 7,246,624, 7,523,757, and 6,609,259, the entire disclosures of which are incorporated herein by reference, provide components that greatly increase the overall efficiency and performance of the machine, including improvements to the intake and discharge manifolds, jets, pump, drain, and system assembly methods. The inventions disclosed in U.S. patent application Ser. No. 12/781,750 (Application Pub. No. US 2011-0120503 A1), the entire disclosure of which is incorporated herein by reference, provide improved rinsing and/or sanitizing systems and methods for washing machines. In addition, International Patent Application PCT/US09/59600 (Application Pub. No. WO 2010/040149) and U.S. patent application Ser. No. 13/080,453 (Application Pub. No. US 2011-0240062 A1), the entire disclosures of which are incorporated herein by reference, provides a condition warning system, control system and control methods for a pot and pan washing machine that addresses a number of disadvantages in typical condition warning systems, control systems and control methods for such machines. U.S. patent application Ser. No. 13/021,682 (US 2011-0240061 A1), the entire disclosure of which is incorporated herein by reference, provides control systems and control methods for a pot and pan washing machine that address yet other disadvantages in typical control systems and methods for such machine. Further in addition, U.S. patent application Ser. No. 12/765,838 (Application Pub. No. US 2011-0017241 A1), the entire disclosure of which is incorporated herein by reference, provides a wash tank insert that greatly improves the wash action within the wash tank and reduces impacts, noise and other vibrations acting on the walls of the wash tank. Notwithstanding these many improvements, the circulating wash action of these type of machines, often results in splashing out of the wash tank that can get employees loading and/or unloading the machine wet and/or which can get the area around the machine wet, particularly at the front of the machine. Therefore, it would be beneficial to provide systems and methods that prevent or reduce fluid from splashing out of the wash tank of such machines, particularly from the front of such machines. In addition, it would be beneficial to provide systems and methods of washing items that further improves the wash action of these type of machines. It would further be beneficial to provide systems and methods that improve heat retention within the wash fluid.

SUMMARY OF THE INVENTION

The present invention comprises a fluid screen for a pot and pan, or other similar washing machine. Several embodiments of the instant invention are discussed herein in connection with the washing machine and the wash tank insert (referenced herein as "AWI System") disclosed in U.S. application Ser. No. 12/765,838. Nevertheless, it will be appreciated that the system and methods of the instant invention may be utilized in connection with pot and pan washing machines (or components thereof), such as those described in any of U.S.

Pat. Nos. 4,773,436, 6,739,348, 7,162,788, 6,976,496, 7,246,624, 7,523,757, and 6,609,259, U.S. application Ser. No. 12/781,750 (Application Pub. No. US 2011-0120503 A1), Ser. No. 13/021,682 (US 2011-0240061 A1), and Ser. No. 12/765,838 (Application Pub. No. US 2011-0017241 A1), and International Patent Application No. PCT/US09/59600 (Application Pub. No. WO 2010/040149), as well as with any other washing machines, or various combinations of washing machine components now known or hereinafter developed without departing from the spirit and scope of the instant invention.

The fluid screen of the instant invention includes a generally planar member including a first end and a second end extending from the first end. The first end is mounted within the wash tank of the washing machine at a location generally in proximity to an operating fluid level within the wash tank. During operation of the washing machine, fluid circulates within the wash tank to create a rolling wash action and the second end of the fluid screen extends from the first end generally in the direction of fluid flow across the surface of the wash tank.

In several preferred embodiments, the fluid screen of the instant invention is mounted within a generally rectangular wash tank of a washing machine that includes a bottom wall, two side walls and two end walls extending upwardly form said bottom wall, said side walls being longer than said end walls. The wash washing machine of such embodiments further includes at least one flow directional opening in at least one of said walls.

In some embodiments, the first end of the fluid screen is mounted to or generally in proximity to one of the walls of the wash tank. In some such embodiments, the first end is mounted to (or generally in proximity to) a wall from which the fluid flow of the wash action of the machine that occurs generally across the top surface of the fluid originates. This allows the second end of the fluid screen to be urged in the direction of travel of the fluid flow and away from the first end. In this manner, the fluid screen floats or rides across the top of the fluid while the machine is in operation. In some such embodiments, the wall is a front wall of said washing machine and the direction of fluid flow across the surface of the fluid during operation of the washing machine is from said front wall to a rear wall generally opposing said front wall.

In some embodiments, the flow directional opening(s) are located in one of the side walls or one of the end walls. Nevertheless, it will be appreciated that in other embodiments, flow directional openings will be located in more than one wall of the wash tank.

In some embodiments, in which the flow directional openings create a rolling wash action by directing the flow of fluid first downward toward the bottom wall of the wash tank and across the bottom wall of the wash tank, the first end of the fluid screen is attached to the wall of the wash tank directly opposing the wall (or walls) in which the flow directional opening(s) are located. In this manner, as the flow moves upward along that opposing wall and is turned back toward the wall in which the flow directional opening(s) are located as the wash action rolls across the top surface of the fluid, the fluid screen will be carried by (or ride/travel across) the fluid such that the second end of the fluid screen will extend along the top of the fluid even if the fluid screen does not float in the fluid while the fluid is stagnant.

In several preferred embodiments, the wash tank includes a fluid flow structure (such as the AWI System as is described in U.S. application Ser. No. 12/765,838). In several such embodiments, the fluid screen is mounted on top of the fluid flow structure. In some such embodiments, the fluid flow structure includes a removable fluid flow guide surface, said guide surface being capable of alternatively being inserted into and removed entirely from said washing machine wash tank, said guide surface including at least one region contoured inconsistently from the contour of at least one corresponding wall of said washing machine wash tank; and a support for said guide surface, wherein said support creates a gap between said guide surface and an interior surface of at least one wall of said washing machine wash tank; wherein a circulating wash action is created in the washing machine wash tank whether said guide surface is inserted into or removed from said washing machine wash tank. In other such embodiments, the fluid flow structure includes a fluid flow guide surface, said guide surface including at least one region contoured inconsistently from the contour of at least one corresponding wall of said washing machine wash tank; and a support for said guide surface, wherein said support creates a gap between said guide surface and an interior surface of at least one wall of said washing machine wash tank; wherein said guide surface and/or said support are capable of flexible motion independent of the walls of said washing machine wash tank.

In some embodiments the second end of the fluid screen is unrestrained. In some such embodiments the fluid screen is made of a generally flexible material. This allows the screen to hang down from the first end when the washing machine is not in operation. In some embodiments, the fluid screen is made of a material that does not float within the fluid. Thus, as the screen hangs down, the send end will sink within the fluid when the machine is not in operation and the fluid is stagnant within the wash tank. When the fluid is in motion again, the second end of the fluid screen will rise to the top of the fluid with the fluid flow and travel across the top surface of the fluid.

In several preferred embodiments, the fluid screen includes one or more slits extending from the second end in a direction generally toward said first end to form two or more fingers. This allows a user of the washing machine to more easily load and unload the wash tank without significant interference created by the fluid screen. The fingers will easily flex up and down to allow wares to be placed through the screen into and out of the wash tank.

In several other embodiments, the fluid screen includes one or more gaps extending from said second end in a direction generally toward said first end to form two or more sections of the screen. In some such embodiments, the gaps are formed between groups of fingers to form sections of fingers. The gaps increase flexibility of the screen to allow for even easier loading and unloading of wares in the wash tank.

In several embodiments, the fluid screen is removably mounted within the wash tank. In some such embodiments, the fluid screen can be easily removed and reinstalled without the use of any tools. In other embodiments tools may be utilized to remove and reinstall the fluid screen. In other embodiments, the fluid screen is permanently mounted within the wash tank. In some such embodiments, the fluid screen cannot be removed without destroying the fluid screen and/or damaging the wash tank.

In some embodiments the length of the fluid screen, from said first end to said second end, comprises a substantial portion of the width of the wash tank along the direction of the fluid flow across the surface of the fluid. In other words, the length of the fluid screen spans a substantial portion of the distance across the top of the wash tank, in the direction of the wash action/fluid flow across the top surface of the fluid. In some such embodiments, the length of the fluid screen is generally and/or at least half of the width across the top of the wash tank. In other embodiments, the length of the fluid screen is generally and or at least two-thirds the width across the top of the wash tank. In still other such embodiments, the length of the fluid screen is generally and/or at least one-third the width of the wash tank. In other embodiments, the length of the fluid screen is relatively short compared to the width across the top of the wash tank. In many such embodiments, the fluid screen will function primarily as a splash shield along one or more walls of the wash tank.

In some embodiments, the splash shield includes a marker that extends in a direction generally perpendicular to the length of the splash shield. In some embodiments the marker is a visual mark. In other embodiments, the marker includes a weakened or perforated section. The marker is a cut-length marker to indicate where the fluid screen may be cut to accommodate wash tanks of various dimensions. This allows a single component to be manufactured and utilized for multiple different wash tanks.

The fluid screen of the instant invention prevents fluid from splashing out of the wash tank. In addition, the fluid screen improves wash action within the wash tank by creating a surface in which wares circulating in the wash tank will frictionally engage. This frictional engagement slows the circulation speed of the items when compared to the circulation speed of the fluid. The turbulence that is created results in an improved scrubbing action on the wares by the fluid. The fluid screen further acts as a lid that keeps wares within the fluid, instead of floating with a portion of the ware above the fluid line, thus further improving the scrubbing action on the wares. The fluid screen further improves heat retention within the fluid of the wash tank by creating at least a partial "lid" over the fluid.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

FIG. 6*a* is a rear side perspective partial sectional view of the fluid-flow plate insert structures of FIG. 3 utilized in connection with an embodiment of the instant invention.

FIG. 6*b* is a detailed view of the fluid screen shown in FIG. 6*a*.

FIGS. 7*a* through 7*h* are various views of the fluid screen shown in FIGS. 6*a* and 6*b*.

FIGS. 8*a* through 8*h* are various view of another fluid screen of the instant invention similar to that of FIGS. 7*a* through 7*h*.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
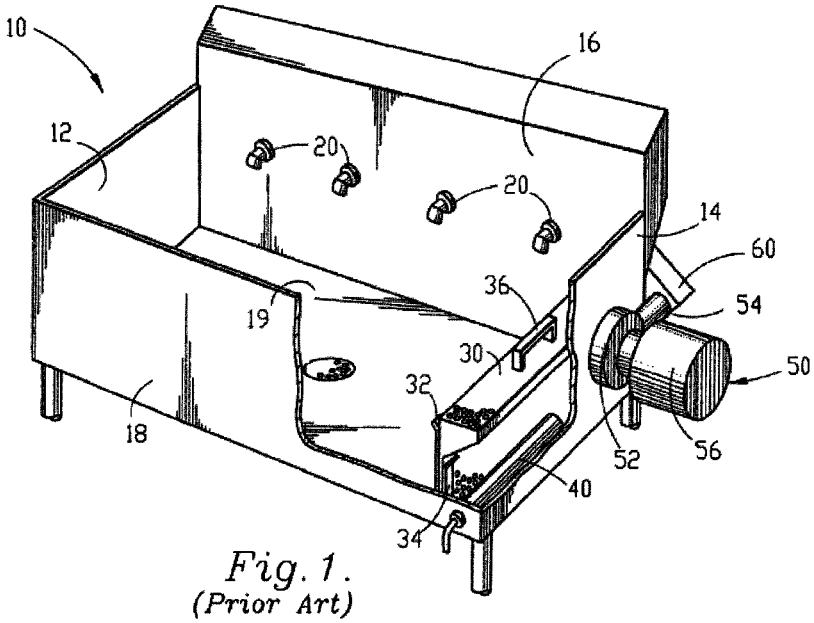
Fig. 1. (Prior Art)
FIG. 1 is a partial perspective view of a pot and pan washing machine of the prior art, in which embodiments of the instant invention may be incorporated.
Figure 2:
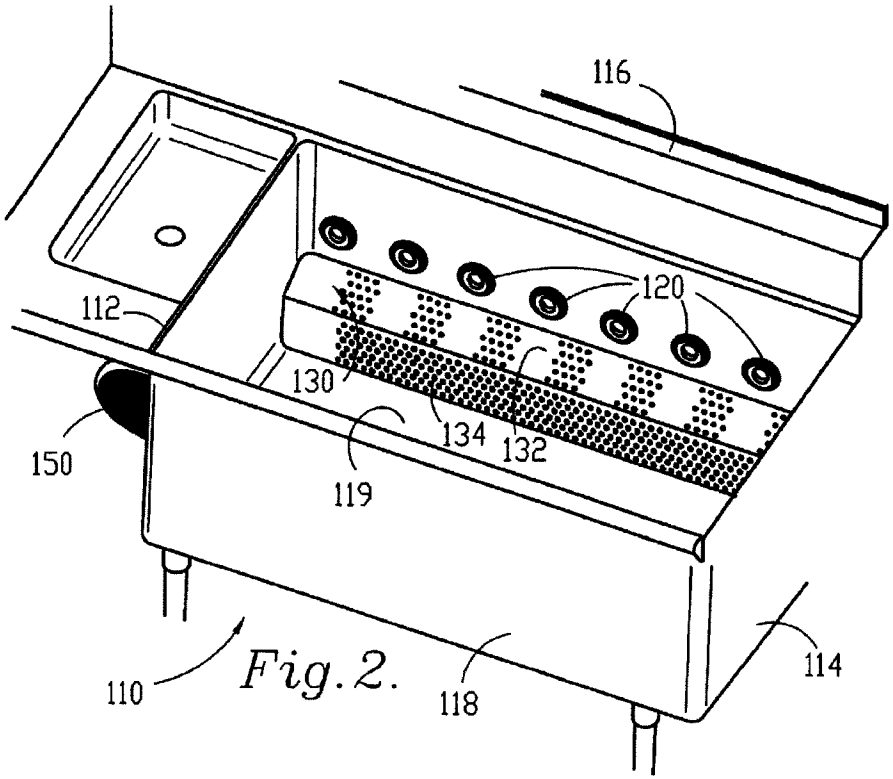
FIG. 2 is a fragmentary perspective view from above of another pot and pan washing machine including a generally linear intake manifold, in which embodiments of the instant invention discussed herein incorporated.

Referring to FIG. 2, an embodiment of a wash tank utilized in connection with the instant invention is shown. The generally rectangular wash tank/basin is constructed in essentially the same manner as the wash tanks of the prior art. Wash tank 110 includes left end wall 112, right end wall 114, rear side wall 116, front side wall 118 and bottom wall 119 constructed in the same or similar manner, and of the same or similar materials as the wash tank of the prior art. Pump 150 is attached to left end wall 112 of the embodiment shown, Nevertheless, pump 150 can be attached to either left end wall 112 or right end wall 114 of wash tank 110. In addition it is understood that pump 150 could be attached to any other wall of the wash tank, or otherwise located separate from the wash tank and connected to the interior of the wash tank via a hose or other piping. Flush mounted jet nozzles 120 are mounted along rear wall 116 equally spaced apart from one another. Intake manifold 130 is mounted within wash tank 110 along the bottom portion of rear wall 116, below nozzles 120. Intake manifold 130 includes an upper portion 132 extending outwardly from rear wall 116 toward front wall 118, and lower portion 134 extending from the front end of upper portion 132. In a preferred embodiment, the upper portion of intake manifold 130 is angled downward from rear wall 116. The downward angle of the upper portion of intake manifold 130 corresponds to the downward angle of jet nozzle 120 which directs a fluid path toward the front portion of bottom wall 119, creating a circulating wash action in the wash tank about a generally horizontal axis of the wash tank. Portions of the intake manifold are perforated to allow fluid to be drawn into manifold 130 by the pump.

Figure 3:
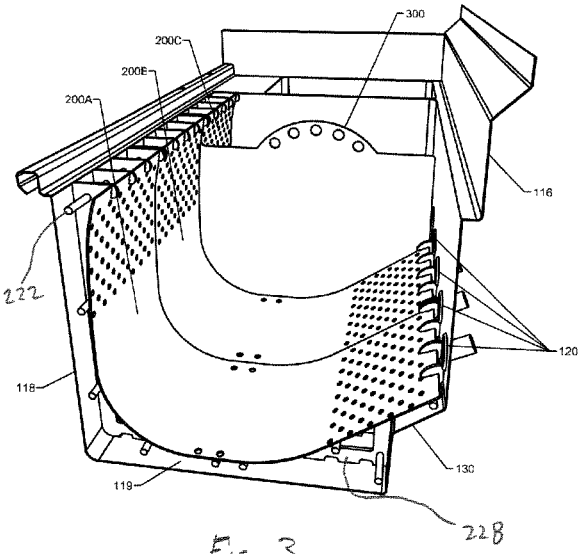
FIG. 3 is a side perspective partial sectional view of several fluid-flow plate insert structures which are utilized in connection with embodiments of the instant invention, the inserts being positioned within the wash tank of a pot and pan washing machine of FIG. 2 and including a divider member between two adjacent sections of insert structures.

Referring to FIG. 3, an embodiment of a wash tank insert is shown that includes three sections (200*a*, 200*b* and 200*c*) of fluid-flow plate insert structures of an embodiment of the invention removably insertable within wash tank 110. Divider member 300 is positioned in a void or slot between adjacent sections 200*b* and 200*c*. The fluid-flow plate insert structures shown in FIG. 3 are generally horizontally orientated within wash tank 110 to aid in or create a circulating wash action about a generally horizontal axis of the wash tank.

The fluid-flow plate insert structure(s) shown in FIG. 3 (200*a*, 200*b* and 200*c*) include two separate support structures, a front support and a rear support, that are each made up of a plurality of ribs 228, and a curved plate (fluid flow guide surface) that rests on top of the support structures. In the embodiment shown in FIG. 3, the ribs are connected together by a plurality of ½ inch diameter rods 222 that run through holes bored in each rib 228. The rods 222 include annular grooves at spaced intervals along the rods' surface. The diameter of the holes in the ribs through which the rod runs are slightly smaller than the diameter of the ½ inch rod. The material of the ribs is slightly flexible and/or malleable to allow the rib to be slid onto the rod until the rib snaps or engages into the grove and is held tightly in place. In such an embodiment, spacers and bolts are not needed to connect the ribs together. It will be appreciated that alternative method of connecting ribs of a section may be utilized without departing from the spirit and scope of the instant invention.

Figure 4B:
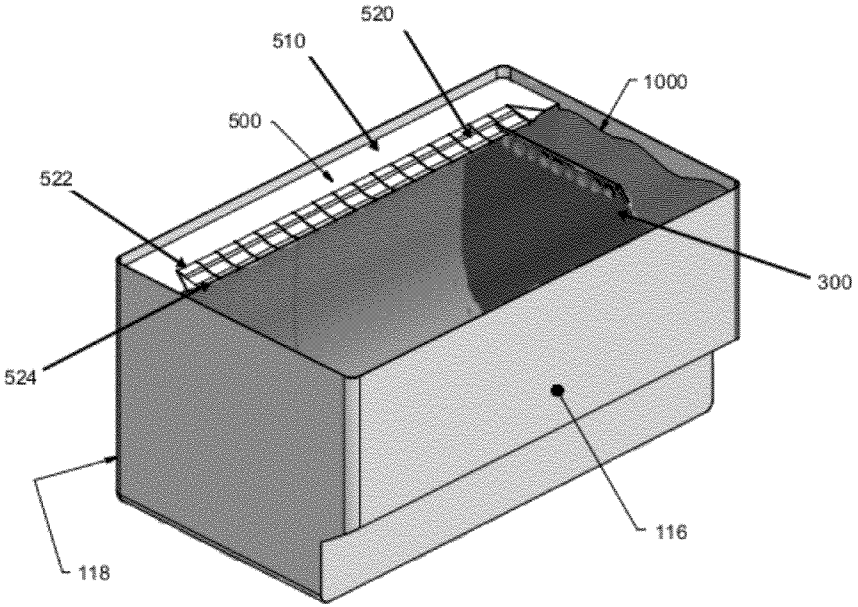
FIG. 4*b* is a rear side perspective view of the wash tank of FIG. 4*a*, in which the fluid within the wash tank is circulating (i.e. with the pump turned on).
Figure 4A:
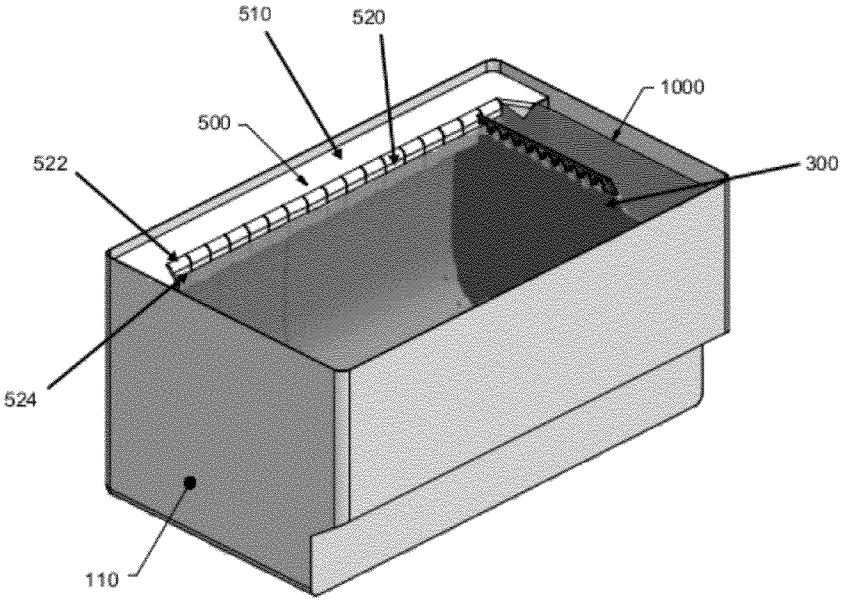
FIG. 4*a* is rear side perspective view of a wash tank of an embodiment of the instant invention, in which the fluid within the wash tank is stagnant (i.e. with the pump turned off).

FIGS. 4*a* and 4*b* show a pot and pan washing machine of an embodiment of the instant invention. In the embodiment of FIGS. 4*a* and 4*b*, the pot and pan washing machine utilizes the wash tank insert system (AWI System) as is described above in connection with FIG. 3. The fluid screen 500 of an embodiment of the instant invention is inserted into the wash tank 110 and rests on top of the AWI System at the front 118 of the wash tank. In the embodiment shown in FIGS. 4*a* and 4*b*, the fluid screen 500 includes a rigid, preferably metal, frame 510 and flexible members (fingers) 520 attached at a first end 522 to the rear edge of the rigid frame. The second end 524 of the flexible members is unrestrained. The flexible members are made of a material such as rubber or other suitable material that is sufficiently flexible to allow the second end 524 of members 520 to hang down from the metal frame in the manner shown in FIG. 4*a*, when the machine is not running (i.e. with the fluid stagnant). In the embodiment shown in FIG. 4*a*, the members 520 do not float in the fluid and thus ends 524 sink into the fluid below the top surface 1000 of the fluid. The fingers are deflected upward by the flow of fluid in the wash tank in the manner shown in FIG. 4*b* when the machine is running with the fluid in the tank circulating. In this manner to fingers 520 float or ride across the top 1000 of the fluid due to the fluid flow. The material of the flexible members is also of suitable weight and/or other properties to at least partially deflect the fluid flowing within the wash tank to prevent or reduce splashing. It will be appreciated that the dimensions of the flexible members may vary without departing from the spirit and scope of the instant invention. In some embodiments, including those embodiments discussed below, the length of the flexible member is longer than the length shown in FIGS. 4*a* and 4*b* to increase the amount of deflection acting on the fluid within the wash tank, and/or to provide other functional benefits.

The rigid frame of the fluid screen shown in FIGS. 4*a* and 4*b* includes a top, two end pieces and a front face piece, which all fit around the wash tank insert (AWI System) within the wash tank. The rigid frame is held in position on the AWI System via connecting members that include slotted leg members extending downward from the top of the fluid screen. The slot of the legs fits around the connecting rod located toward the top of the AWI System that connects together multiple support ribs of the AWI System. In some embodiments the connecting members are integral with the metal frame, in other embodiments the connecting members are separate from the rigid frame. In some embodiments in which the connecting members are separate from the rigid frame, the connecting members fit on the AWI System in the manner discussed above, and the rigid frame rests on a generally flat top of the connecting members.

Figure 5:
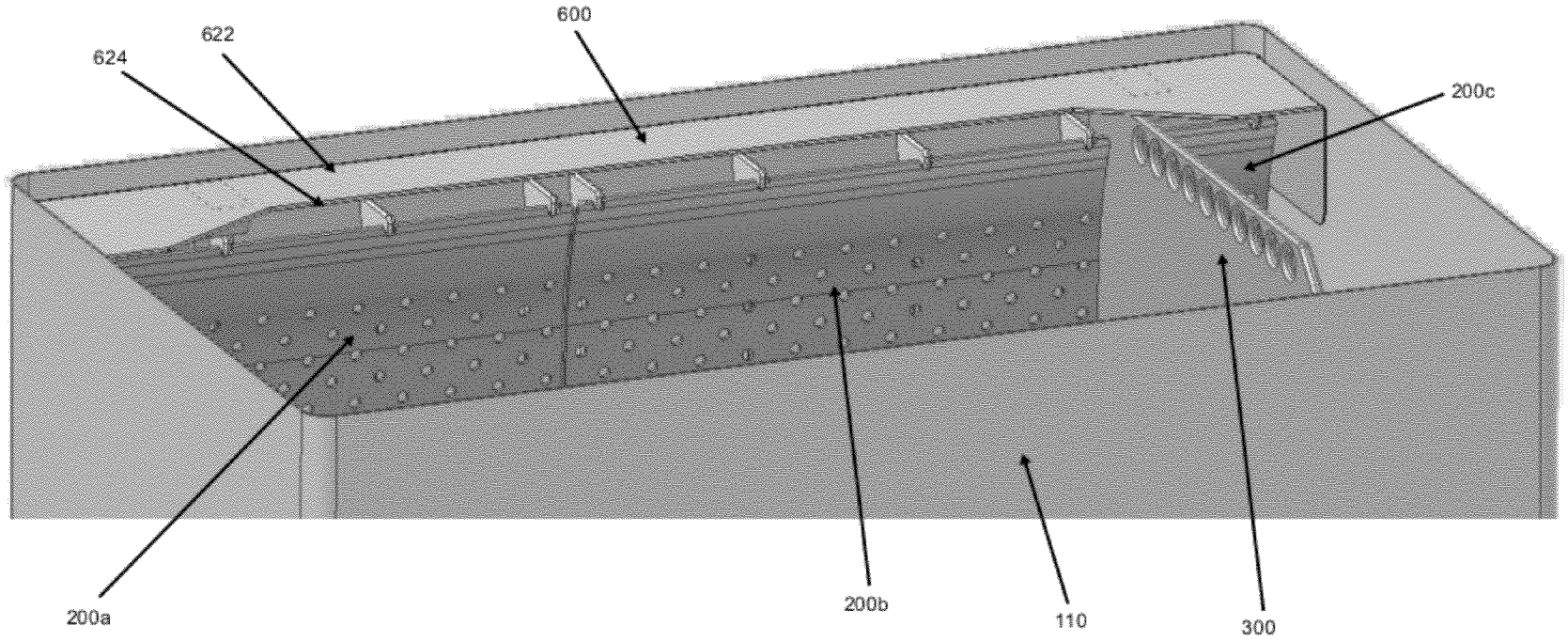
FIG. 5 is a rear side partial perspective view of a wash tank of another embodiment of the instant invention.
Figures 7A, 7B, 7C, 7D, 7E:
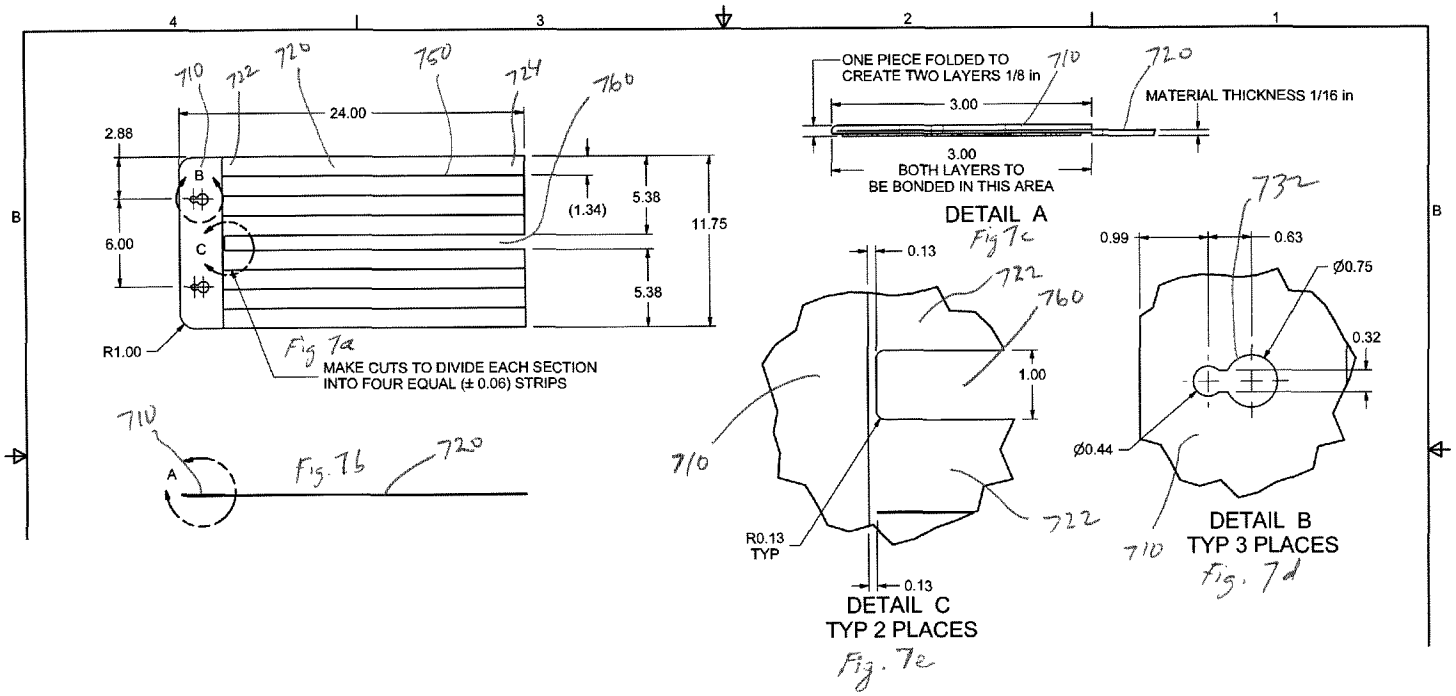

Referring to FIG. 5, another embodiment of a fluid screen 600 of the instant invention is shown that does not include the flexible members shown in FIGS. 4*a* and 4*b*. In the embodiment shown in FIG. 5, fluid screen 600 is a rigid frame (600) that includes first end 622 located generally in proximity to (or up against) the front wall of the wash tank, and a second end 624 extending inward toward the center of the wash tank from the first end. The top portion of the rigid frame 600 acts to deflect fluid from splashing over the front edge of the wash tank. The rigid frame 600 (and associated mounting members) shown in FIG. 5 is identical to the rigid frame 510 shown in FIGS. 4*a* and 4*b* except for the exclusion of the flexible members 520 of FIGS. 4*a* and 4*b*. Nevertheless, it will be appreciated that in some embodiments, the dimensions of the rigid frame may vary. For example, in some embodiments the top of the rigid frame for a fluid screen without flexible members extend further inward into the wash tank to increase fluid deflection.

Referring to FIGS. 6*a* and 6*b*, another embodiment of a fluid screen 700 of the instant invention is shown. In the embodiment shown in FIGS. 6*a* and 6*b*, fluid screen 700 includes a first end mount 710 that is attached to the front wall 118 of wash tank 100 of the washing machine, and fingers 720 that extend from the rear edge 722 of the mount 710 toward unrestricted second ends 724. The wash tank shown in FIGS. 6*a* and 6*b* includes insert structures 200*a*, 200*b*, and 200*c* as described in FIG. 3. As is shown in detail in FIG. 6*b*, an angled bracket 740 extends over the front lip of front wall 118 of the wash tank and over the top of the insert structures. A shoulder stud 730 extends through the bracket to provide an attachment member for removable engagement with keyhole 732 of the fluid screen. It will be appreciated that bracket 740 may be integral with front wall 118 of the wash tank, or in some embodiments may be a separately attachable member. As is shown in FIG. 6*a*, shoulder stud 730 extends downward and over rod 222 of the insert structures for additional support of the structure.

Referring to FIGS. 7*a* through 7*h*, various detailed views of the fluid screen of FIGS. 6*a* and 6*b* are shown. As is discussed above, fluid screen 700 includes a first end mount 710 that attaches to the front wall 118 of wash tank 100 of the washing machine, and fingers 720 that extend from the rear edge 722 of the mount 710 toward unrestricted second ends 724. Keyhole 732 is located within mount 710. In the embodiment shown in FIGS. 7*a* through 7*h*, the fluid screen is made from a single piece of generally flexible material, such a rubber or other suitable material. Mount 710 is formed by folding the end of the material over itself and bonding the two layers together. This provides added strength to mount 710 while allowing the fluid screen to remain flexible. Cuts or slits 750 are made in the material extending from second end 724 toward mount 710 to form multiple fingers 720 that can flex independent of one another. In addition gap 760 is formed in the middle of the fluid screen shown in FIGS. 7*a* through 7*h*, to form two separate sections of 4 fingers in each section. This increases flexibility between sections to allow for easier loading and unloading of items through fluid screen 700 into and out of the wash tank. Diamond imprints 715 are formed in mount 710 to improve bonding between layers and for added rigidity as well as aesthetics.

Referring to FIGS. 8*a* through 8*h*, various detailed views of another fluid screen similar to that of FIGS. 7*a* through 7*h* are shown. As is discussed above with respect to FIGS. 7*a* through 7*h*, fluid screen 700 includes a first end mount 710 that attaches to the front wall 118 of wash tank 100 of the washing machine, and fingers 820 that extend from the rear edge 722 of the mount 710 toward unrestricted second ends 824. Keyhole 732 is located within mount 810 for mounted to shoulder stud 730. In the embodiment shown in FIGS. 8*a* through 8*h*, the fluid screen is made from a single piece of generally flexible material, such a rubber or other suitable material. Mount 710 is formed by folding the end of the material over itself and bonding the two layers together. This provides added strength to mount 710 while allowing the fluid screen to remain flexible. Cuts or slits 750 are made in the material extending from second end 724 toward mount 710 to form multiple fingers 720 that can flex independent of one another. In addition gaps 760 are formed in the middle of the fluid screen shown in FIGS. 8*a* through 8*h*, to form three separate sections of 4 fingers in each section. This increases flexibility between sections to allow for easier loading and unloading of items through fluid screen 700 into and out of the wash tank. Diamond imprints 715 are formed in mount 710 to improve bonding between layers and for added rigidity as well as aesthetics. The fluid screens shown in FIGS. 7*a* through 7*h* and 8*a* through 8*h* are constructed in two different dimensions to allow for various combinations of separate fluid screens to be utilized in connections with wash tanks of numerous different dimensions. It will be appreciated that other dimensions and combinations of dimensions of fluid screens may be utilized without departing from the spirit and scope of the instant invention.

Figure 9:
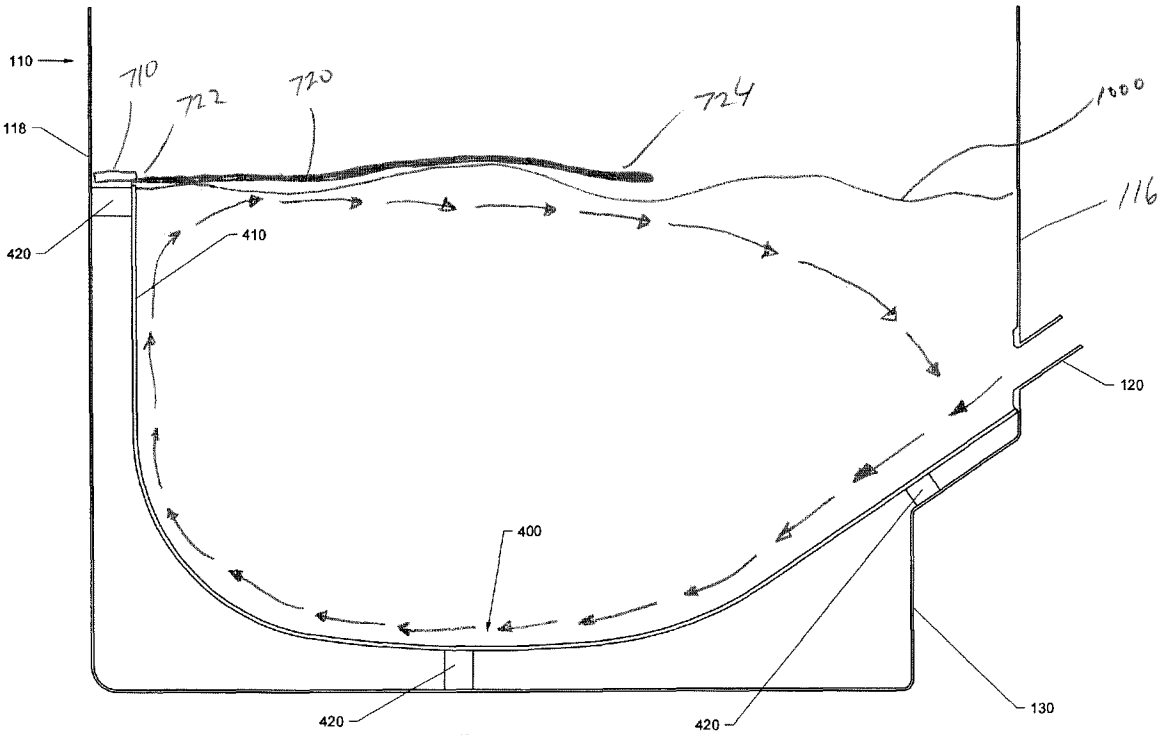
FIG. 9 is a side sectional view of another embodiment of a fluid-flow plate insert structure which is utilized in connection with embodiments of the instant invention, the insert shown positioned within the wash tank of the pot and pan washing machine of FIG. 2.

Referring to FIG. 9 a side sectional view of another embodiment of a wash tank of the instant invention is shown. The wash tank 110 includes a fluid-flow plate insert structure 400 positioned within the wash tank. In the embodiment shown in FIG. 8, the support structure for the curved plate 410 includes a plurality of bumpers 420 located within the wash tank to create spacing between the walls of the wash tank 110 and the curved plate 410 of the fluid-flow plate insert structure. The curved plate is attached to the bumpers via glue, welding or any other suitable attachment mechanism now known or hereinafter developed. In the embodiment shown, the bumpers are made of a rubber or plastic material to increase noise dampening. Nevertheless, it will be appreciated that any suitable material for the bumpers may be utilized without departing from the spirit and scope of the instant invention. In the embodiment shown, each of the bumpers generally span the length of the wash tank from side to side. Nevertheless, it will be appreciated that shorter bumpers and/or that a plurality of bumpers spaced along the length of the wash tank may be utilized without departing from the spirit and scope of the instant invention.

In the embodiment shown in FIG. 9, fluid screen 700 is mounted above the insert structure 400 in a manner similar to that discussed above with respect to FIGS. 6*a* and 6*b*. As is shown in FIG. 9, the rolling wash action within wash tank 110 is initiated by jets (flow directional openings) 120 located along rear wall 116, which direct the jet stream towards the bottom wall (or in this case, the insert structure) of the wash tank. The wash action flows along the bottom wall towards front wall 118 and upward along front wall. The wash action then turns back toward rear wall and travels generally across the top surface 1000 of the fluid from front wall 118 to rear wall 116. The fluid flow across the top surface 1000 of the fluid cause the second unrestricted end 724 of the fluid screen to float or ride upward and toward the back of the wash tank on top of the fluid. This results in the fluid screen to push downward on the fluid, preventing splashing, improving heat retention and improving fluid flow within the wash tank.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A fluid screen for a washing machine wash tank, the fluid screen comprising:

a generally planar member including a first end and a second end;

wherein said first end is mounted within the wash tank at a location generally in proximity to an operating fluid level within the wash tank;

wherein said second end is unrestrained such that said second end extends from said first end generally in the direction of fluid flow across the surface of the fluid during operation of the washing machine and further such that said second end is operable to maintain a position generally adjacent to the surface of the fluid during operation of the washing machine; and wherein said generally planar member includes one or more gaps extending from said second end in a direction generally toward said first end.

2. The fluid screen as claimed in claim 1 wherein said generally planar member is made of a generally flexible material.

3. The fluid screen as claimed in claim 2 wherein said second end hangs down from said first end when the washing machine is not in operation.

4. The fluid screen as claimed in claim 3 wherein said second end sinks in the fluid when the fluid is stagnant.

5. A fluid screen for a washing machine wash tank, the fluid screen comprising:

a generally planar member including a first end and a second end;

wherein said first end is mounted within the wash tank at a location generally in proximity to an operating fluid level within the wash tank;

wherein said second end is unrestrained such that said second end extends from said first end generally in the direction of fluid flow across the surface of the fluid during operation of the washing machine and further such that said second end is operable to maintain a position generally adjacent to the surface of the fluid during operation of the washing machine; and wherein said generally planar member includes one or more slits extending from said second end in a direction generally toward said first end to form two or more fingers.

6. The fluid screen as claimed in claim 5 wherein said generally planar member includes one or more gaps extending from said second end in a direction generally toward said first end to form two or more sections of fingers.

7. The fluid screen as claimed in claim 1 wherein said first end is removably mounted within the wash tank.

8. The fluid screen as claimed in claim 1 wherein said first end is mounted to a wall of said washing machine.

9. The fluid screen as claimed in claim 8 wherein said wall is a front wall of said washing machine and wherein the direction of fluid flow across the surface of the fluid during operation of the washing machine is from said front wall to a rear wall generally opposing said front wall.

10. The fluid screen as claimed in claim 1 wherein a length of said generally planar member from said first end to said second end comprises a substantial portion of the width of the wash tank along the direction of the fluid flow across the surface of the fluid.

11. The fluid screen as claimed in claim 10 wherein the substantial portion of the width of the wash tank is at least one half the width of the wash tank.

12. The fluid screen as claimed in claim 10 wherein the substantial portion of the width of the wash tank is at least two-thirds the width of the wash tank.

13. The fluid screen as claimed in claim 10 wherein the substantial portion of the width of the wash tank is at least one-third the width of the wash tank.

14. The fluid screen as claimed in claim 1 wherein said generally planar member includes at least one cut-length marker between said first end and said second end.

15. A washing machine comprising:

a generally rectangular wash tank including a bottom wall, two side walls and two end walls extending upwardly form said bottom wall, said side walls being longer than said end walls;

at least one flow directional opening in at least one of said walls;

a fluid screen within said wash tank, said fluid screen comprising:

a generally planar member including a first end and a second end;

wherein said first end is mounted within said wash tank at a location generally in proximity to an operating fluid level within the wash tank; and wherein said second end is unrestrained such that said second end extends from said first end generally in the direction of fluid flow across the surface of the fluid during operation of the washing machine and further such that said second end is operable to maintain a position generally adjacent to the surface of the fluid during operation of the washing machine; and a fluid flow structure within said wash tank, said fluid flow structure comprising:

a removable fluid flow guide surface, said guide surface being capable of alternatively being inserted into and removed entirely from said washing machine wash tank, said guide surface including at least one region contoured inconsistently from the contour of at least one corresponding wall of said washing machine wash tank; and a support for said guide surface, wherein said support creates a gap between said guide surface and an interior surface of at least one wall of said washing machine wash tank;

wherein a circulating wash action is created in the washing machine wash tank whether said guide surface is inserted into or removed from said washing machine wash tank.

16. The washing machine as claimed in claim 15 wherein at least one of said at least one flow directional opening is located in one of said side walls or one of said end walls.

17. The washing machine as claimed in claim 16 wherein said first end of said fluid screen is mounted generally in proximity to a wall generally opposing the wall in which said at least one of said at least one flow directional opening is located.

18. A washing machine comprising:

a generally rectangular wash tank including a bottom wall, two side walls and two end walls extending upwardly form said bottom wall, said side walls being longer than said end walls; at least one flow directional opening in at least one of said walls;

a fluid screen within said wash tank, said fluid screen comprising:

a generally planar member including a first end and a second end;

wherein said first end is mounted within said wash tank at a location generally in proximity to an operating fluid level within the wash tank; and wherein said second end is unrestrained such that said second end extends from said first end generally in the direction of fluid flow across the surface of the fluid during operation of the washing machine and further such that said second end is operable to maintain a position generally adjacent to the surface of the fluid during operation of the washing machine; and a fluid flow structure within said wash tank, said fluid flow structure comprising:

a fluid flow guide surface, said guide surface including at least one region contoured inconsistently from the contour of at least one corresponding wall of said washing machine wash tank; and a support for said guide surface, wherein said support creates a gap between said guide surface and an interior surface of at least one wall of said washing machine wash tank;

wherein said guide surface and/or said support are capable of flexible motion independent of the walls of said washing machine wash tank.

* * * * *

UNITED STATES PATENT AND TRADEMARK OFFICE

CERTIFICATE OF CORRECTION

PATENT NO. : 9,027,575 B2
APPLICATION NO. : 13/332360
DATED : May 12, 2015
INVENTOR(S) : Cantrell et al.

It is certified that error appears in the above-identified patent and that said Letters Patent is hereby corrected as shown below:

In the Claims

Column 11, Line 57, Claim 15, delete "form said bottom wall"; insert --from said bottom wall--

Column 12, Line 37, Claim 18, delete "form said bottom wall"; insert --from said bottom wall--

Signed and Sealed this
Twenty-second Day of September, 2015

Michelle K. Lee

Michelle K. Lee
*Director of the United States Patent and Trademark Office*